United States Patent [19]

Bange

[11] 4,362,619

[45] Dec. 7, 1982

[54] CONTINUOUS CENTRIFUGAL MACHINE

[75] Inventor: Joseph B. Bange, Hamilton, Ohio

[73] Assignee: The Western States Machine Company, Hamilton, Ohio

[21] Appl. No.: 113,980

[22] Filed: Jan. 21, 1980

[51] Int. Cl.[3] ..... B04B 9/00

[52] U.S. Cl. ..... 210/360.1

[58] Field of Search ..... 210/360, 361, 362, 363, 210/364, 365, 366; 233/3, 20 A, 21; 64/11 B, 4, 11 R, 23, 23.6, 23.5, 27 NM; 474/113, 148, 149, 150

[56] References Cited

U.S. PATENT DOCUMENTS

| | | | |
|---|---|---|---|
| 2,166,406 | 7/1939 | Henry | 474/113 |
| 2,960,883 | 11/1960 | Sznycer | 474/113 |
| 3,333,707 | 8/1967 | Bange et al. | 210/365 |
| 3,362,243 | 1/1968 | Ferguson | 474/113 |
| 3,727,429 | 4/1973 | Downey | 64/11 R |
| 3,888,093 | 6/1975 | Downey | 64/11 R |
| 3,910,068 | 10/1975 | O'Connor | 64/11 R |

*Primary Examiner*—Theodore A. Granger
*Attorney, Agent, or Firm*—Albert C. Johnston; Ronald A. Clayton

[57] ABSTRACT

An improved continuous centrifugal machine includes a rigid base structure, a bearing housing, a normally vertical basket shaft journalled for rotation on bearings in the bearing housing, an upwardly open frusto-conical centrifugal basket secured to the upper end of the basket shaft for rotation therewith, a stationary curb wall mounted on the base structure and surrounding the basket, buffering assemblies for resiliently mounting the bearing housing on the base structure to permit gyration of the basket, and a motor mounted to one side of the curb wall and connected by an improved system to the lower end of the shaft for rotating the basket. The system for connecting the motor to the basket shaft comprises a support shaft mounted in a fixed position beneath and substantially aligned with the basket shaft. A belt pulley is supported for rotation on a bearing carried on the support shaft and a driving belt connects the belt pulley with a second pulley driven by the motor. The belt pulley carries a stub shaft that is coaxial with the support shaft and a structure mounting the support shaft holds its axis vertical and is displaceable and settable horizontally to being its axis into exact alignment with the axis of the basket shaft in rest position. A flexible coupling interconnects the stub shaft and the lower end of the basket shaft to directly transmit torque yet permit angular and parallel misalignment therebetween, whereby moment loads are removed from the bearing housing mounting assemblies and gyration of the basket is unrestrained by and does not alter the driving moment of the belt.

3 Claims, 4 Drawing Figures

FIG. 3
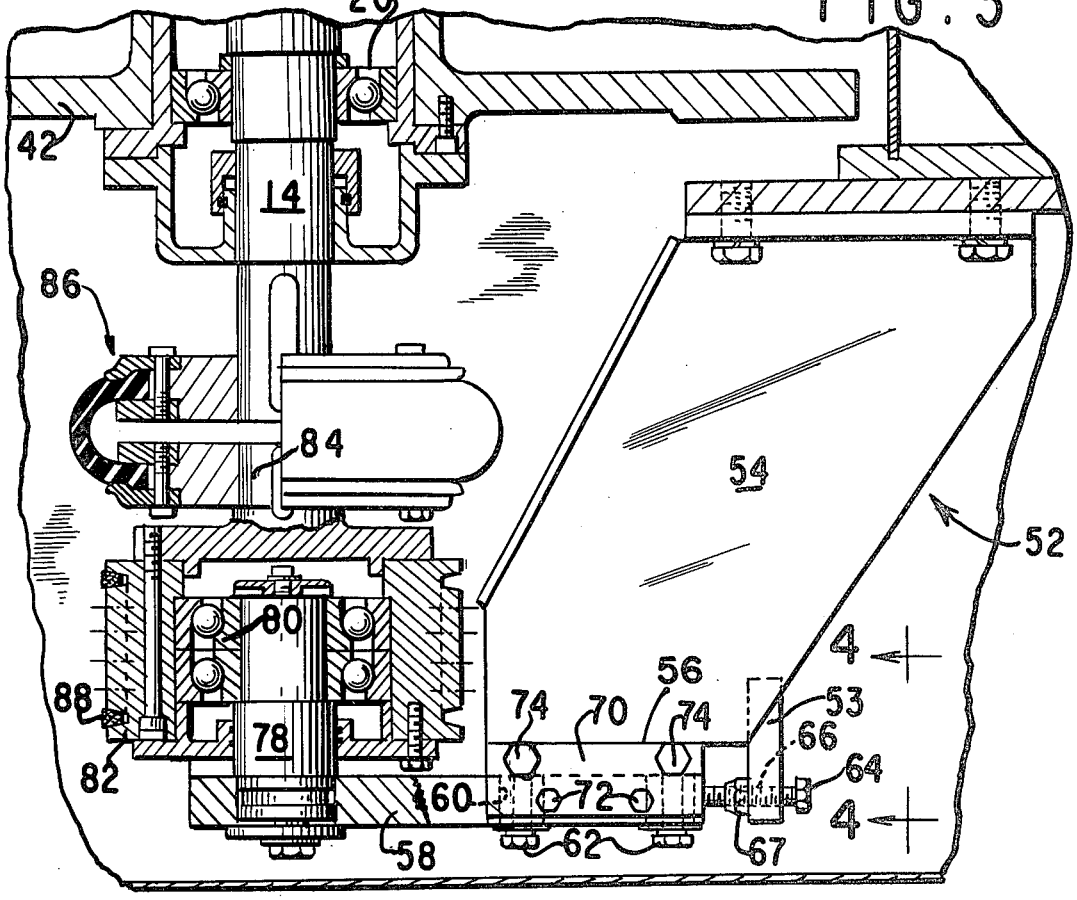
FIG. 4
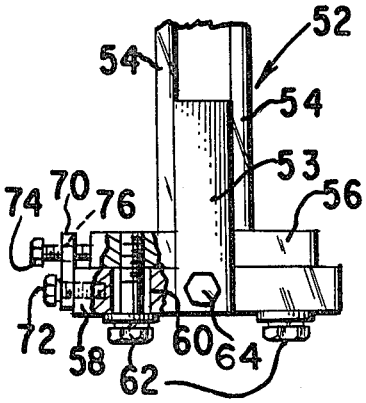
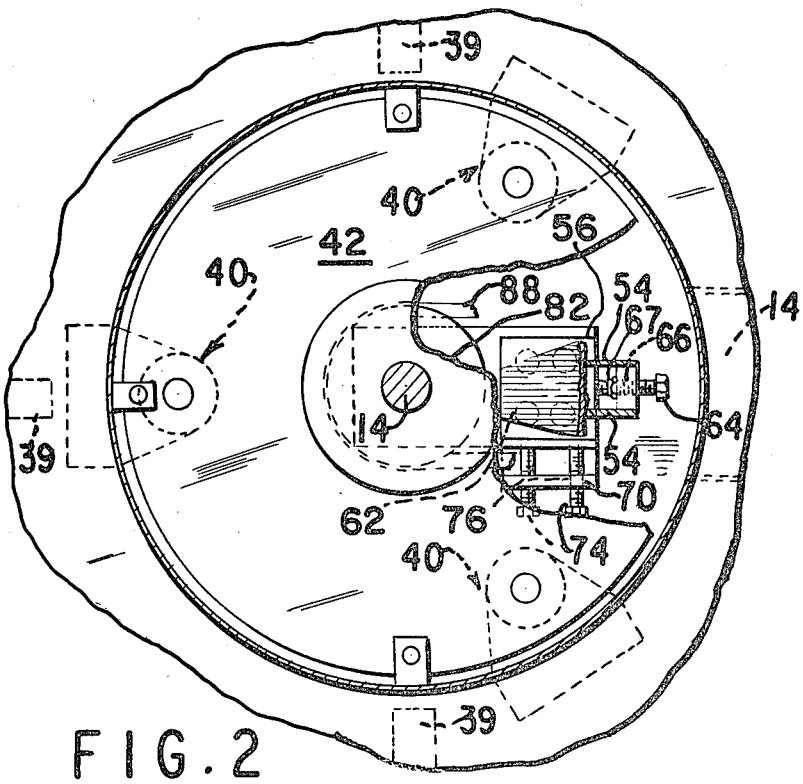
FIG. 2

CONTINUOUS CENTRIFUGAL MACHINE

The present invention relates generally to a continuous centrifugal machine and is particularly directed to an improved system for connecting a prime mover, specifically a motor, to the lower end of a basket shaft to which the basket is secured for rotation.

Continuous centrifugal machines of the conical basket type are particularly useful for separation of sugar crystals from syrup in the manufacture of sugar. Such machines typically include a frusto-conical basket having a perforate circumferential side wall into which a mixture of liquid and solids, for example, massecuite, is fed adjacent the small diameter end of the basket. When the basket is rotated, the mixture will continuously travel toward the large diameter end under the influence of centrifugal force. A cylindrical casing wall concentrically surrounds the basket and has one end proximate to the large diameter end of the basket to define a liquids receiving chamber around the basket. An outer curb wall is spaced radially outward from the partition to define therebetween a chamber for receiving solids discharged over the top of the large diameter end of the basket.

In continuous centrifugals of the type described above, the basket is secured to a shaft that is rotated by a drive belt which runs under the basket to and around a driven pulley fixed to the basket shaft. The drive belt is also connected with a driving pulley driven by a rotary prime mover such as a motor.

Proposals for flexibly mounting the basket have been made in the past. For example, U.S. Pat. No. 3,333,707 (Bange et al.) discloses a centrifugal machine in which the basket assembly is mounted for gyratory movement under the influence of imbalanced loads though resilient buffering assemblies which are located at the level of the driven pulley so that gyrations will take place about a point on the rotational axis at the center of the driven pulley, thus limiting overstressing of the drive belt.

Operating difficulties are encountered in the use of the machines mentioned in that gyrations of the rotating basket assembly and/or variations of the shaft position set by the buffering assemblies cause uneven loading and wear of the drive belt.

Other continuous centrifugal machines incorporating flexible mountings for the centrifugal basket and independent basket driving mechanisms are disclosed in U.S. Pat. No. 2,406,187 (Bayless); U.S. Pat. No. 3,050,190 (Siepe); U.S. Pat. No. 1,395,193 (Lindenberg) and in "Report on the Hein-Lehmann Continuous Centrifugal", Boyes, 1957 and German Auslegeschrift No. 1,170,326 (Hein-Lehmann & Co.).

The principal object of the present invention is to provide an improved continuous centrifugal machine of the type mentioned by which difficulties or shortcomings such as those noted can be overcome.

It is an object of the present invention to provide a continuous centrifugal machine of the type generally described above that includes a flexible mounting arrangement for the basket of the machine and an improved system for connecting rotary drive means such as a motor with a driven basket shaft, using a driving belt so that belt loads are removed from the resilient mounts and so that the basket shaft is unrestrained by and does not alter the driving moment of the driving belt.

In accordance with this invention, the continuous centrifugal machine includes a rigid base structure, a bearing housing, a normally vertical basket shaft journalled for rotation on bearings in the housing, and an upwardly open frusto-conical basket secured to the upper end of the basket shaft for rotation therewith. A stationary curb wall is mounted on the base structure and surrounds the basket. A plurality of buffering assemblies resiliently mount the basket on the base structure so as to permit gyration of the basket about a point on the axis of the shaft. A rotary drive for the shaft includes a motor mounted to one side of the curb wall.

According to one feature of the invention, the improved system for connecting the motor with the lower end of the basket shaft to rotate the basket comprises a non-rotary support shaft mounted in fixed position beneath and substantially aligned with the basket shaft. A driven belt pulley is supported for rotation about the axis of the support shaft by a bearing carried on the support shaft. The driven pulley carries a stub shaft coaxial with the support shaft and substantially aligned with the basket shaft. A driving belt runs around the driven belt pulley and from it to and about a second, driving pulley powered by the motor, and a flexible coupling interconnects the stub shaft and the lower end of the basket shaft for directly transmitting torque yet for permitting angular and parallel misalignment therebetween. As a result, the basket shaft is unrestrained by and does not vary the moment loads of the driving belt, and the resilient buffering assemblies are isolated from the influence of belt loads on the driven pulley.

The above, and other objects, features and advantages of this invention will be apparent from the following detailed description of an illustrative embodiment thereof, which is to be read in connection with the accompanying drawings. In the drawings:

FIG. 2 is a horizontal cross-sectional view taken through plane 2—2 in FIG. 1.

FIG. 3 is a side elevational view taken partly in cross-section of an assembly for adjusting the rest position of support and stub shafts to align the stub shaft with the basket shaft.

FIG. 4 is a rear elevation of the adjustment assembly.

Figure 1:
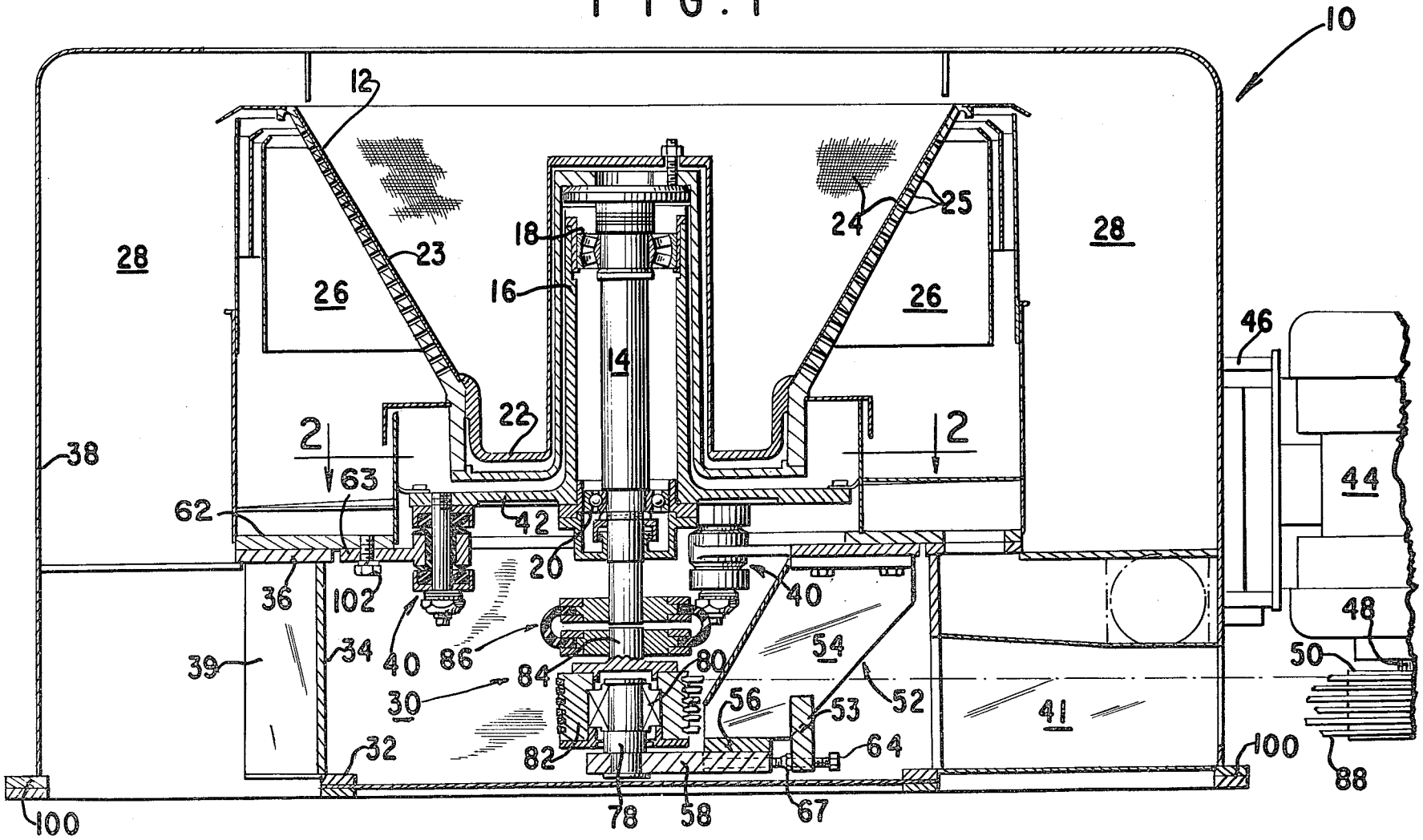
FIG. 1 is a vertical cross-sectional view of a continuous centrifugal machine made in accordance with the present invention.

As shown in FIG. 1, the illustrative embodiment of the improved continuous centrifugal machine of the present invention is generally indicated at 10, and includes a frusto-conical basket 12 mounted for rotation on a normally vertical basket shaft 14 that is supported for rotation in a bearing housing 16 on upper and lower bearings 18 and 20 respectively. The basket may be driven at high rotary speed by a rotary prime mover such as a motor through an improved system for connecting the motor to the basket shaft described below in detail.

When the machine is operated, a mixture of liquids and solids to be centrifuged or separated is fed into the basket, while it is continuously rotated, through a supply pipe (not shown) that extends from above the basket and discharges at a location adjacent the bottom surface 22 of the basket. The mixture travels upwardly and outwardly along the inner surface of the frusto-conical side wall 23 of the basket under the influence of centrifugal force. A perforated screen 24 is mounted adjacent the side wall of the basket, which itself is provided with suitable drain openings 25 that extend therethrough.

Thus, as the mixture travels upwardly along the side wall of the basket, centrifugal force also causes liquid constituents to travel outwardly through the screen and the side wall openings 25 for collection in an inner liquid collecting chamber 26. Solid constituents of the mixture are discharged radially outwardly over the top edge of the basket 12 and fall for collection in an outer solids delivering space 28 provided between the outer wall of the chamber and a surrounding curb wall 38.

It is possible for the mixture being centrifuged to be distributed non-uniformly within the basket during operation of the continuous centrifugal machine, thereby resulting in an imbalance of the basket with respect to its axis of rotation, which coincides with the basket shaft 14. This imbalance of material in the basket, in turn, tends to cause the basket to gyrate about its axis of rotation. If the basket is inflexibly mounted so as to rigidly resist gyration, undesirable vibration will frequently develop in the bearings 18 and 20 that causes them to wear rapidly. Moreover, such vibration will be transmitted into the mounting structure of the centrifugal machine. As noted above, because of these inherent problems in rigidly, inflexibly mounting the basket for rotation, resilient flexible assemblies for mounting a continuous centrifugal machine basket with a rigid base structure have been proposed. However, in machines employing such mounting assemblies, care should be taken to avoid undesirable stressing of the system for connecting the rotary prime mover to the basket shaft and basket and to avoid inhibition of the gyratory motion of the basket. The present invention relates particularly to an improved system for connecting the rotary prime mover to the basket shaft so that the flexible mounting of the basket is not restrained or stressed by the connecting system, that is, so moment loads are removed from the mounting arrangement.

The connecting system of the invention, generally indicated at 30, is mounted within a base structure of the continuous centrifugal machine that comprises a lower base ring 32 and a cylindrical column 34 secured to and projecting upwardly from the base ring, and curb support ring 100. A strong radially outwardly extending ring support 36 is mounted on the upper end of the column 34 at a location spaced inwardly from the curb wall 38. The curb wall 38 is secured at its lower margin to a curb ring 100. As shown in FIG. 2, for increased rigidity, several vertical stiffening ribs 39 extend radially between the curb wall and the column. Also extending between them is a radial arrangement of a belt tunnel (41 superposed by a liquid outlet tunnel. At least three resilient mounting or buffering assemblies, generally indicated at 40 and which may be of the type described in detail in U.S. Pat. No. 3,333,707 (Bange et al.), are equally spaced/apart inside the support ring 36 and a base wall 62 that forms a part of a chambering unit. Hangers 63 for the buffering assemblies are secured by bolts 102 to the inner portion of the base wall. The bearing housing 16 is formed at its lower end with a surrounding support flange 42 that extends radially outwardly to hub formations which are part of the buffering assemblies 40. The flexible buffering assemblies 40, flexibly interconnect the base wall 62, and hence the base structure, and the bearing housing so that the gyratory assembly of the bearing housing, the basket shaft and basket can gyrate to a limited extent against resistance imposed by the elastic elements of the buffering assemblies about a point on the axis of the shaft 14 when the rotary mass of the basket with material in it is imbalanced.

A large electric motor 44, the prime mover, is mounted on a suitable mounting bracket 46 on the outside of the curb wall 38 and has a vertically arranged drive shaft 48 that carries a drive pulley 50. The drive pulley 50 drives a wide multiple unit V-belt 88 which extends through the belt tunnel 41 to and about a driven pulley 82 coupled with the basket shaft 14.

According to the present invention, the driven pulley 82 is mounted in a fixed position below and substantially coaxially with the basket shaft 14, as by being fixed on a non-rotary support shaft 78 through anti-friction rotary bearings 80, and is flexibly coupled with the lower end of the basket shaft 14 through a flexible coupling 86 which joins the shaft end with an upwardly protruding stub shaft 84 mounted on and for rotation with the pulley 82.

Flexible coupling 86 directly transmits torque between the pulley 82 and the basket shaft 14 while permitting angular and parallel misalignments between the axes of the basket shaft and the stub shaft under the working conditions of the machine. A flexible coupling suitable for this purpose is available commercially, for instance as a "Dodge Paraflex" coupling.

In order to establish and maintain alignment of the basket shaft with the stub shaft 84 for a balanced operation of the coupling between the pulley 82 and the basket shaft 14, an adjustable mounting and positioning arrangement is provided for effecting fine adjustments of the position of the support shaft 78 of the driven pulley 82 relative to the axis of rotation of the basket shaft. This arrangement, shown in FIGS. 1 through 4, is supported by a mounting bracket 52 which is rigidly fixed to part of the base structure of the machine and has an inverted T-shape formed by a vertical web portion 54 and a horizontally arranged butt plate 56. The bracket 52 holds in centilevered relation an adjustably positioned arm 58 in which the support shaft 78 is fixed, and which holds the support shaft end of the pulley 82 securely in a desired set position. The arm 58 is adjustable in position relative to the butt plate 56 both radially in directions toward and away from the driving pulley and in either direction transverse to the radial directions. For this purpose, the adjustment arm is provided with radially and laterally enlarged openings 60 and is secured to the butt plate by lock bolts 62 that pass through these openings and are threaded in bores tapped into the butt plate. The mounting bracket 52 further includes a depending lug 53 that has set screw 64 threaded into a bore 66 of the lug with an end of this screw bearing radially against the outer end of the adjustment arm. The set screw is held in any set position by a lock nut 67 which, when loosened lets the set screw be turned to adjust the position of the adjustment arm in a radial direction.

For setting the arm position transversely, an upstanding plate 70 is secured to one side of the adjustment arm by bolts 72 and two set screws 74 passed through it are engaged with a side edge portion of the butt plate 56. One of the screws 74 is threaded through a tapped bore 76 in the plate 70 and bears at its end against the adjacent side edge of the butt plate 56. The other set screw 74 passes freely through a bore in the plate 70 and is threaded in a bore tapped into the adjacent side of the butt plate. Thus, by turning the screws 74, the arm may be adjusted in either direction of their motion to set the adjustment arm in a desired position within the range of adjustment provided by the enlarged opening 60. To adjust the position of the stub shaft 84 for proper driving action through the flexible coupling, the lock bolts 62 and the lock nuts 67 are first loosened and the set screws 74 are disengaged from the butt plate 56. By then turning the set screw 64, the arm 58 can be pushed radially in the direction away from the pulley or can be brought to a position radially nearer to it by the tension of the drive belt 88. The range of radial adjustment is determined by the radial length of the opening 60 less the diameter of the lock bolt 62. Also, the set screws 74 can be turned to set the adjustment arm transversely to any desired position within the range of adjustment provided by the width of the openings 60 less the diameter of the bolts 62. When the pulley 82 and stub shaft 84 are properly positioned for providing the proper alignment of the stub shaft relative to the basket shaft, the lock nut 67 and lock bolt 62 are tightened so that the arm 58 will be held securely in the set position.

It will be appreciated from the description provided above that the system for connecting the motor with the basket shaft permits the basket to gyrate without restraining forces being exerted by the belt on the basket shaft, because the basket shaft is isolated from the driven pulley 82 and stub shaft 84 by the flexible coupling 86. Gyration of the basket does not alter the driving moment of the belt or the stress or tension of the belt. Moment loads ordinarily applied to the resilient mounting assemblies through the basket shaft by the belt are eliminated.

Therefore, the drive system provided for the machine enables a substantially uniform smooth driving action of the belt 88 to be maintained through the flexible coupling 86 and avoids the variations of moment loads on the belt which exist when the driven pulley is fixed to the gyratory basket shaft.

Also, the resilient buffering assemblies function without being affected by moment loads of the belt on the driven pulley. To the extent that those assemblies from time to time may let a change occur in the set position of the axis of the basket shaft, a resultant irregularity of driving action through the flexible coupling can be compensated by an adjustment of the position of the driven pulley carrying the stub shaft.

It is to be understood that the preferred embodiment of the continuous centrifugal machine of the present invention has been described above in detail. Modification may be made to the described structure in order to adapt it to particular applications.

What is claimed is:

1. In a continuous centrifugal machine including a rigid base structure, a bearing housing, a normally vertical basket shaft journalled for rotation on bearings in said bearing housing, a basket secured to the upper end of said shaft for rotation therewith, a stationary curb wall surrounding said basket, means for resiliently mounting said bearing housing on said base structure so as to permit gyration of said basket about a point on the axis of said shaft, and rotary drive means including a motor mounted to one side of said curb wall and means connecting said motor with the lower end of said shaft for rotating said basket continuously at high speed, the improvement wherein said connecting means comprises:

a non-rotary support shaft mounted in adjustably fixed position beneath and substantially aligned with said basket shaft;

anti-friction rotary bearing means mounted on said support shaft and a driven belt pulley supported on said support shaft through said bearing means for rotation about the axis of said support shaft;

driving belt means connecting said driven pulley with a driving pulley driven by said motor;

a stub shaft fixed to said driven belt pulley for rotation coaxially therewith;

mounting means constantly positioning and sustaining the loads on said support shaft, said mounting means being displaceable to and settable in a position thereof in which the axis of the driven pulley and stub shaft is held aligned with the rest position of the axis of the lower end of the basket shaft; and flexible coupling means interconnecting said stub shaft and the lower end of said basket shaft for directly transmitting torque yet permitting angular and parallel misalignment therebetween; whereby moment loads are removed from said bearing housing mounting means and gyration of said basket shaft is unrestrained by and does not alter the driving moment of said belt means.

2. A continuous centrifugal machine according to claim 1, said shaft mounting means comprising a mounting bracket secured in fixed relation to said base structure, an arm connected with said bracket and having said support shaft fixed thereto, said arm being displaceable horizontally relative to said bracket in opposite directions radially of said curb wall and in opposite directions transverse to said radial directions, and adjustably settable means on said bracket and said arm for displacing and setting said arm to a position of alignment of said axes.

3. A continuous centrifugal machine according to claim 2, said adjustably settable means including a set screw threaded through a bore in a part on said bracket and extending in said radial directions and having an end bearing against an end of said arm, said screw being operable to set said arm and said driven pulley in said radial directions, and set screws extending through bores in a part on said arm and engaged with a part on said bracket and operable to set said arm in said transverse directions.

* * * * *